United States Patent [19]

Bommier et al.

[11] Patent Number: 5,032,244

[45] Date of Patent: Jul. 16, 1991

[54] ANODIC TREATMENT APPARATUS FOR ALUMINIUM ALLOY PISTONS

[75] Inventors: Christophe Bommier, Paris; Philippe Gimenez, Echirolles; Gérard Laslaz, St Laurent Du Pont, all of France

[73] Assignee: Pechiney Recherche, Courbevoie, France

[21] Appl. No.: 528,544

[22] Filed: May 25, 1990

[30] Foreign Application Priority Data

Jun. 7, 1989 [FR] France ..... 89 08138

[51] Int. Cl.[5] ..... C25D 17/00

[52] U.S. Cl. ..... 204/224 R; 204/224 M

[58] Field of Search ..... 204/224 R, 224 M

[56] References Cited

U.S. PATENT DOCUMENTS

| | | | |
|---|---|---|---|
| 2,698,832 | 1/1955 | Swanson | 204/224 R |
| 2,745,805 | 5/1956 | Jones, Jr. | 204/224 M |
| 3,573,176 | 3/1971 | Laznovsky | 204/224 R X |
| 4,118,303 | 10/1978 | Gibbs | 204/224 R |

FOREIGN PATENT DOCUMENTS

| | | |
|---|---|---|
| 232211 | 8/1987 | European Pat. Off. . |
| 727406 | 11/1952 | United Kingdom . |

*Primary Examiner*—Donald R. Valentine

*Attorney, Agent, or Firm*—Dennison, Meserole, Pollack & Scheiner

[57] ABSTRACT

An apparatus for the anodic treatment of aluminum alloy pistons used in internal combustion engines. The apparatus comprises at least two members applied symmetrically to the lateral cylindrical surface of the piston which are connected to a source of positive direct current. An electrode connected to a source of negative direct current and having at least one aperture therein is positioned adjacent the head portion of the piston which is to be treated. A deflector of electrically insulating material disposed generally parallel to and spaced from the electrode and having a circumference curved toward the electrode is provided with a central passage therethrough which receives the head portion of the piston, with the head portion being disposed opposite the electrode. The deflector surface facing the electrode is provided with a flexible means for sealing the deflector to the head portion and a regulated flow of anodizing electrolyte is provided through the aperture in the electrode, in the direction of the deflector and the head portion. This apparatus can be applied to the high speed production of barrier coatings which are confined to the piston heads and which can prevent development of heat stresses which could adversely affect the satisfactory functioning of the piston. The coatings are produced without the use of masks or treatments other than the anodic treatment.

1 Claim, 1 Drawing Sheet

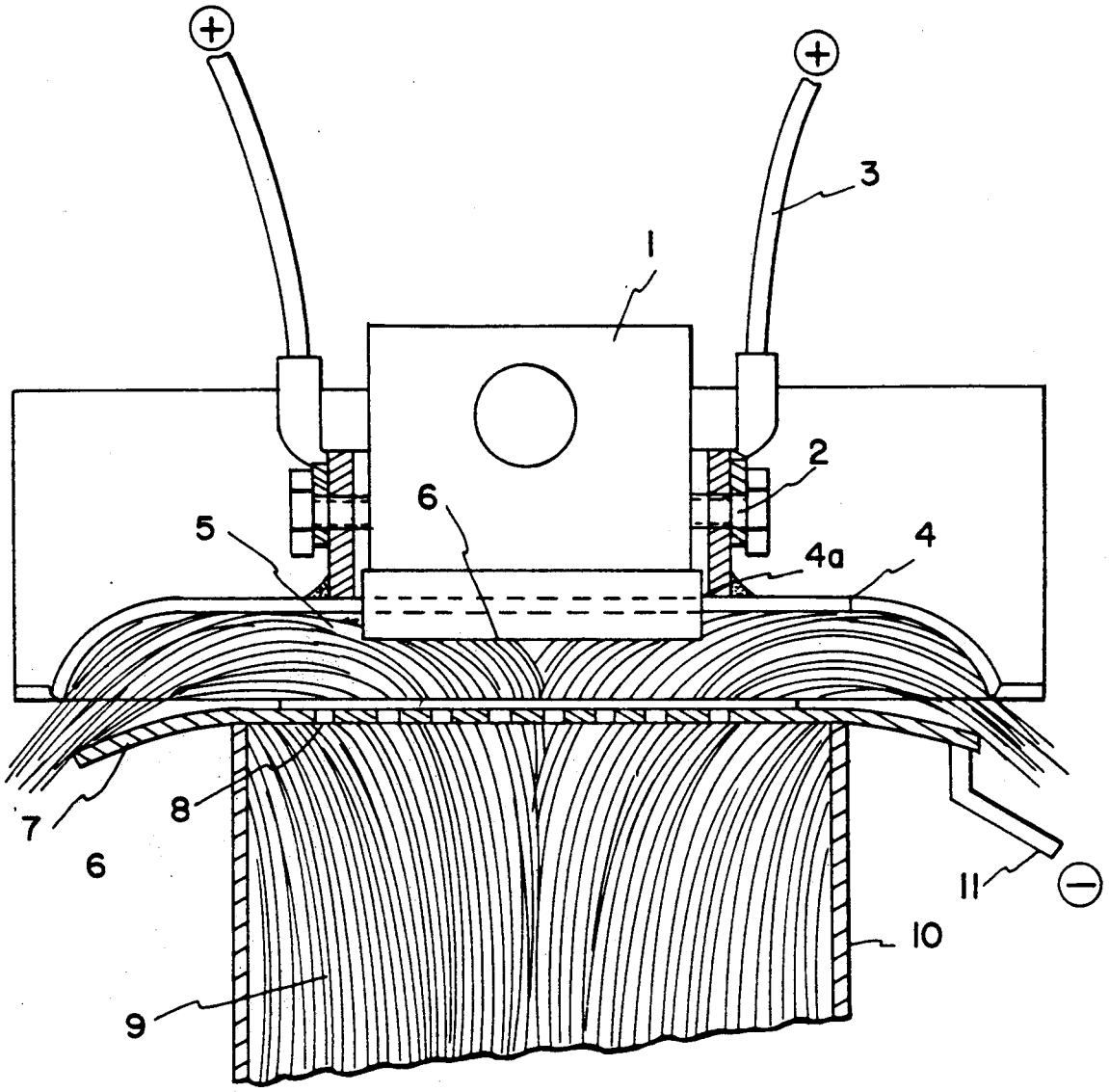
Figure

ANODIC TREATMENT APPARATUS FOR ALUMINIUM ALLOY PISTONS

The invention relates to an apparatus for the anodic treatment of aluminium alloy pistons used in internal combustion engines.

It is well known that in internal combustion engines the parts of the pistons situated close to the combustion zone and more particularly the heads are in contact with relatively hot gases and are therefore subject to high thermal stresses which may in particular result in deformations or changes in the metallurgical structure which may adversely affect the satisfactory functioning of the said engines.

To attenuate the affects of these stresses, particularly in the case of pistons made from aluminium alloy, a man skilled in the art knows that he can, for example, treat them by electrolytic oxidation or anodisation in order to develop an oxide coating on their surface, referred to as a heat barrier, which will protect the metal of the piston from the unfavourable action of heat.

This anodic treatment is conventionally performed by immersion of the piston in a bath of electrolyte and by passing an alternating or direct current of electricity between the said bath and the said piston, the latter serving as an anode if a direct current is being used.

In view of the fact that it is above all the head region which has to be protected, it appears pointless and uneconomic to proceed with complete anodisation of the piston, the more so since this operation may adversely affect the surface condition of some other parts of the said piston. That is why, prior to anodisation, coverings or masks of wax or polymeric material are generally placed on those areas of the piston where it is desired to maintain the surface in its original state.

This practice calls for additional labour entrusted firstly with placing the masks in position and then removing them either by dissolution or by any other means and this results in an increase in the total time and overall cost of the treatment.

Furthermore, for the oxide coating to act as a heat barrier with sufficient efficacy, its thickness must be at least equal to 50 microns so that it becomes necessary to carry out anodisation until considerable anode-cathode tensions are established. Under these conditions, there is a risk of damaging the coating by the burning phenomenon, which is an acceleration and localised dissolution of the said coating under the effect of a high concentration of current densities at certain points and which gives rise to substantial local increases in temperature. To overcome this risk, it is necessary to confine oneself to the use of current densities of less than 10 A/sq.dm and therefore to extend the anodisation time beyond a half-hour in order to arrive at a suitable thickness of oxide.

It is necessary also for this coating to have a good resistance to heat fatigue and that it should be sufficiently hard that it cannot become dislocated when the piston is in operation. To arrive at this result, it is known, following anodisation, to carry out certain treatments such as a compression of the coating as is claimed, for example, in French Patent No. 2 354 450.

Conscious of the problems posed by the production of pistons coated with suitable heat barriers, the Applicants have sought and found a solution which does away with the use of masks and extended anodisation times while imparting the required properties to the oxide coating and doing so without having recourse to operations other than the actual anodic treatment.

This solution resides in employing an apparatus for the anodic treatment of aluminium alloy pistons used in internal combustion engines and which is characterised in that the lateral cylindrical surface of the said piston is connected to the positive pole of a direct current source via at least two members which are applied symmetrically to the said surface and in that it is equipped along a directrix situated close to the head with a deflector which consists of electrically insulating material, the circumference of which is downwardly curved and of which the surface at the head end is placed opposite an electrode connected to the negative pole of the current source and in which there is at least one aperture which allows passage of a regulated flow of anodising electrolyte which is directed towards the head and of which the surface facing the said electrode is provided with a flexible seal which bears against the surface of the piston.

In this invention, the piston is therefore connected to the positive pole of a source of direct current by at least two members which are placed symmetrically in relation to the axis of the piston and which are applied against its lateral surface in such a way as to achieve a satisfactory distribution of current and an homogenised anodised coating.

The lateral surface of the piston is equipped with a deflector, a kind of preferably circular plate, the circumference of which is curved downwardly in accordance with a profile adapted to the flow of electrolyte. This deflector is supported along a directrix of the piston which is situated as close as possible to the head and its function is to act as a screen for any passage of electrolyte towards the top of the piston so limiting the effect of anodisation almost exclusively to the head.

As it is not easy to achieve total sealing-tightness between the deflector and the lateral surface of the piston, nor to place the latter at the level of the head, it is preferable to provide it with a sealing-tight gasket which bears on the said surface as far as the level of the head.

The material used for making this deflector may be any electrically insulating material which can be suitably shaped.

Facing the surface of this deflector, on the head side, there is an electrode which is preferably circular in shape, its circumference being curved slightly downwardly. This electrode is connected to the negative pole of the said current source and is preferably provided with at least one aperture in its centre.

Through this aperture there passes a regulated flow of electrolyte supplied by a feed pipe and which washes around the piston head, anodising it prior to escaping through the annular space existing between the deflector and the electrode in a direction which matches the supply profile, possibly after having been cooled. The flow of electrolyte may be regulated by any known means such as a volumetric pump or a constant hydrostatic pressure feed system.

It is obvious that the circuits which are in contact with the electrolyte are made from a material which is chemically inert in respect of this latter.

Such an apparatus makes it possible to remedy the above-mentioned drawbacks. Indeed, on the one hand, by virtue of the presence of the deflector and possibly of the sealing-tight gasket, only the piston head is anodised and there is therefore no need to have recourse to masks or coverings.

Furthermore, the passage of a regulated flow of electrolyte towards the head makes it possible to establish a hydrodynamic regime which is adapted to the dimensions of the surface to be anodised, ensuring a high speed of heat dissipation so that it is possible in particular considerably to increase the anodising current density without causing a "burn". Furthermore, the almost entire mass of the piston is in the free air and acts as a heat dissipater and likewise contributes to the possibility of using high current densities.

Furthermore, such an apparatus makes it possible to obtain oxide coatings of considerable thicknesses which may exceed 70 microns, achieving this in less than 5 minutes, and these coatings naturally, that is to say without any further treatment, exhibit appropriate hardness and resistance to fatigue.

The invention will be more clearly understood from the drawing FIGURE, which shows a vertical section through the apparatus.

The drawing shows a piston 1 on the lateral wall of which there is fixed, by means of screws 2, the current supply means 3 which leads to the positive pole of a current source, not shown. This supply is rigid with the deflector 4 provided with a flexible seal 5 and a central passage 4*a* for receiving piston head 6. Facing the head 6 which is to be anodised there is an electrode 7 provided in its centre with a plurality of apertures 8 through which passes a flow of electrolytes 9 carried by the pipe 10 connected to a propulsion means, not shown, which makes it possible to ensure a regular supply. Electrode 7 is connected to the negative pole of the current source by a current supply means 11.

The invention may be illustrated by the following example of application:

On the lateral wall of an aluminum alloy piston of type AS12UN (that is to say containing by weight approx. 12% silicon, 1% copper and 1% nickel as main elements of addition), there is fixed a direct current supply connected to the positive pole of a source. This supply is rigid with a deflector mounted on the wall of the piston. A titanium electrode provided with holes was placed at 5 cm from the head and connected to a pipe in which circulated the electrolyte containing 180 g/l $H_2SO_4$ at 5° C. A current density of 50 A/sq.dm was passed for 3 minutes and an oxide coating was obtained to a thickness of 65 microns and showing no signs of burning. Various measurements were then carried out on the piston. First of all, it was noted that the coating had a hardness of between 200 and 300 HV. This piston was then subjected to heat fatigue stresses, the cycle of which is shown below:

change from −20° C. to 350° C. in 15 seconds
air cooling 15 seconds
water cooling 15 seconds
air drying 15 seconds.

Tests were carried out up to 6000 cycles. After 1000 cycles, a slight porosity was apparent. But it was only after 5000 cycles that the coating started to become detached. Cracks appeared at 6000 cycles but their depth (0.5 mm) is less than with a conventional process.

To enhance the hardness of the coating, tests were repeated under the same conditions and with the same apparatus as previously but the electrolyte was made up as follows:

| | |
|---|---|
| $H_2SO_4$ | 180 g/l |
| $H_2C_2O_4$ (oxalic acid) | 10 g/l |

and its temperature was 0°0 C.

After anodic treatment at the same current density, it was possible in under 5 minutes to obtain a coating the thickness of which was greater than 60 microns. Its heat fatigue strength was comparable with that obtained in the previous example but the hardness was greater than 400 HV, a value deemed adequate for the application in question.

We claim:

1. An apparatus for the anodic treatment of a head portion of an aluminum alloy piston having a lateral cylindrical surface adjacent the head portion, said apparatus comprising:

at least two members adapted to be applied symmetrically to the lateral cylindrical surface;

means for connecting said members to a source of direct current at a positive pole thereof;

an electrode having at least one aperture therein;

means for connecting said electrode to a source of direct current at a negative pole thereof;

a deflector of electrically insulating material disposed generally parallel to and spaced from said electrode and having a circumference curved toward said electrode, said deflector having a central passage therethrough adapted to receive the head portion of the piston for anodic treatment, the head portion to be disposed opposite said electrode;

said deflector having a surface facing said electrode which is provided with a flexible means for sealing said deflector to the head portion received in said central passage; and means for supplying a regulated flow of anodizing electrolyte through the aperture in said electrode, in the direction of said deflector and the head portion.

* * * * *